US007246709B2

(12) United States Patent
Kim

(10) Patent No.: US 7,246,709 B2
(45) Date of Patent: Jul. 24, 2007

(54) TOOTHBRUSH AND TOOTHPASTE HOLDER

(76) Inventor: Young-Chan Kim, 125-1303 Hanshin Apt, Seohyun-Dong, Bundang-Gu, Sungnam (KR)

( * ) Notice: Subject to any disclaimer, the term of this patent is extended or adjusted under 35 U.S.C. 154(b) by 0 days.

(21) Appl. No.: 10/545,599

(22) PCT Filed: Feb. 18, 2004

(86) PCT No.: PCT/KR2004/000331

§ 371 (c)(1),
(2), (4) Date: Aug. 15, 2005

(87) PCT Pub. No.: WO2004/073475

PCT Pub. Date: Sep. 2, 2004

(65) Prior Publication Data

US 2006/0145042 A1 Jul. 6, 2006

(30) Foreign Application Priority Data

Feb. 19, 2003 (KR) ..... 20-2003-0004815

(51) Int. Cl.
*A47B 81/02* (2006.01)

(52) U.S. Cl. ..... 211/65

(58) Field of Classification Search ..... 211/65, 211/69.1, 10, 119.009; 248/110
See application file for complete search history.

(56) References Cited

U.S. PATENT DOCUMENTS

| | | | | | |
|---|---|---|---|---|---|
| 712,824 | A | * | 11/1902 | Masland | 211/65 |
| 1,581,250 | A | * | 4/1926 | Treubig | 248/311.2 |
| 3,156,364 | A | * | 11/1964 | Wolcott | 211/65 |
| 5,480,038 | A | * | 1/1996 | Collier | 211/65 |
| 6,053,338 | A | * | 4/2000 | Avery et al. | 211/65 |

FOREIGN PATENT DOCUMENTS

| | | |
|---|---|---|
| JP | 11-332653 | 7/1999 |
| JP | 2000-271028 | 3/2000 |

* cited by examiner

*Primary Examiner*—Sarah Purol
(74) *Attorney, Agent, or Firm*—IPLA P.A.; James E. Bame

(57) ABSTRACT

A toothbrush and toothpaste holder of the type that has two different cylindrical-shapes of which one side is a usual cup shape where a toothpaste can be stored while the other side that the cylinder has higher degrees of taper and shrinking down to the bottom where is open but has a cone shaped post with eight dividers that could hold eight toothbrushes in a sanitary position automatically by gravity.

4 Claims, 9 Drawing Sheets

TOOTHBRUSH AND TOOTHPASTE HOLDER

TECHNICAL FIELD

This invention relates to toothbrush and toothpaste holder, and in particular, to the holder that can store one or more toothbrushes together with a toothpaste in a sanitary and easy-to-use position automatically.

BACKGROUND ART

Summarizing the technical background of toothbrush and toothpaste holder, it is known that many different shapes of circular, quadrangular or even triangular cup-like containers have been developing and using for storing toothbrushes and toothpaste together in a casual and careless manner however, due to the sanitary concern such as toothbrush could communicate a disease such as hepatitis, so that more complicated configuration of containers were developed to hold the toothbrushes in separate compartments and can be removed without disturbing other toothbrushes and furthermore, as filed in U.S. Pat. application Ser. No. 6,286,3190 that discloses and claims a toothbrush holder that supports one or more toothbrushes, and an ultraviolet irradiating light device to treat the brush and thus kill any germs present within the brush. However, most of the cases, the newly developed toothbrush and toothpaste holders were not free from the complicated configuration that eventually resulted the holders should be mounted on the wall and additionally, electric (for the holders with ultraviolet light device) wiring is required to supply electricity. Above all, the newly developed holders are not as easy-to-use as to the conventional cup shape holders.

DISCLOSURE OF INVENTION

1. Technical Problem

The technical problem is to develop a toothbrush and toothpaste holder, which is equally easy to handle toothbrush and toothpaste when insert to and remove from the container compare with the conventional cup shape holder and at the same time, it should be able to store the toothbrushes not disturbing other toothbrushes for a sanitary reason.

2. Technical Solution

The present invention discloses a sanitizing toothbrush and toothpaste holder consists of two different cylindrical-shapes where one (could be more by the size) toothpaste rest in one side and one or up to eight toothbrushes can rest on the other side, which has eight compartments created by cone shaped post in the middle with eight dividers.

3. Advantageous Effects

In accordance with the present invention, a toothbrush and toothpaste holder for holding one or up to eight toothbrushes together with one or more toothpastes in sanitary position as the toothbrushes and a toothpaste(s) are not disturbing each other. Plastic or like materials may be used in making the holders in a cost effective way as the configuration of the holder would be applicable for a singe-body (one-piece) mold injected plastic production.

BEST MODE FOR INVENTION

An exemplary embodiment of a toothbrush and toothpaste holder is that the unit consists of two different cylindrical-shapes that the one side 1 of the container is slightly tapered cup shape, which is designed to hold one toothpaste together with other beauty supplies such as combs and brushes as the remaining space is available. The other side 2 of the container has higher degrees of taper so that shrinking down quickly to the bottom where is open through but has a cone shaped post 4 with eight wing-shaped dividers 3 that could hold one or up to eight toothbrushes, which are slightly tilted outward automatically by gravity. It eventually results the holder to be able to store up to eight toothbrushes in a sanitary manner as the toothbrushes are not disturbing each other.

The nature and mode of operation of preferred embodiments of the present invention will now be more fully described in the following detailed description, taken with the accompanying drawings.

Figure 1:
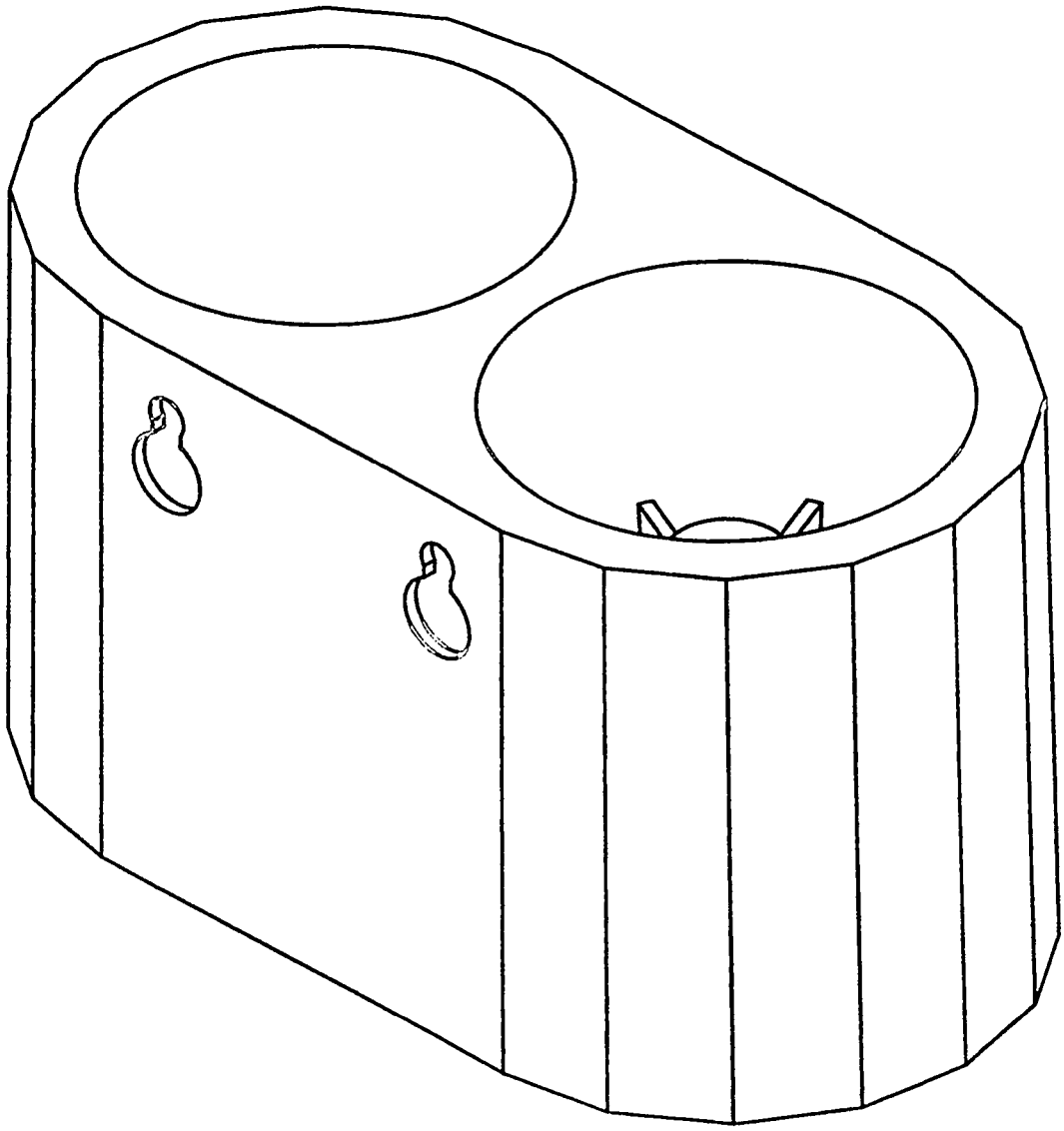
FIG. 1 is a perspective view (a bird's eye view) of a toothbrush and toothpaste holder
Figure 2:
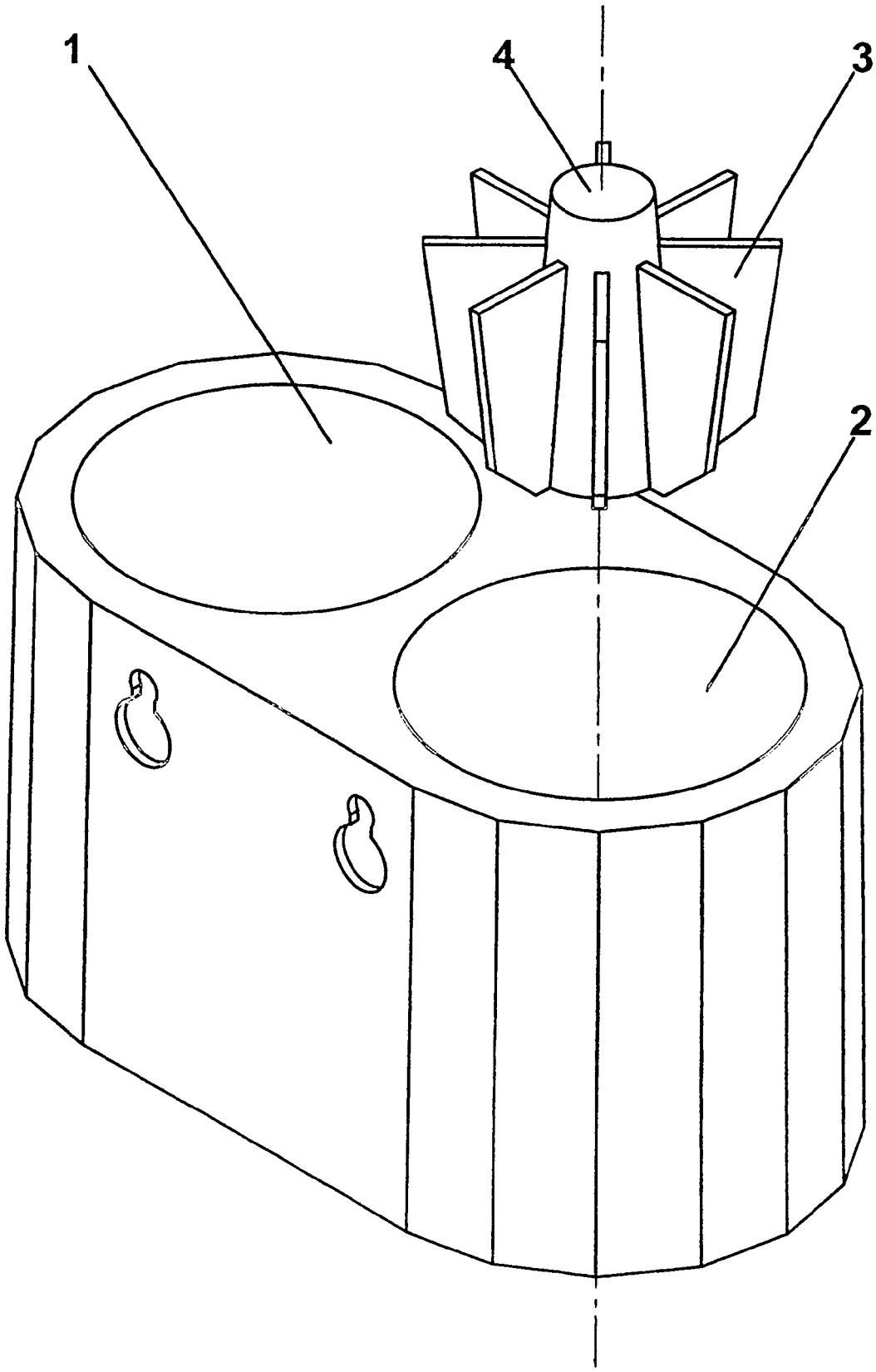
FIG. 2 is a deal drawing that shows the main body of the holder with a cone shaped post having eight dividers
Figure 3:
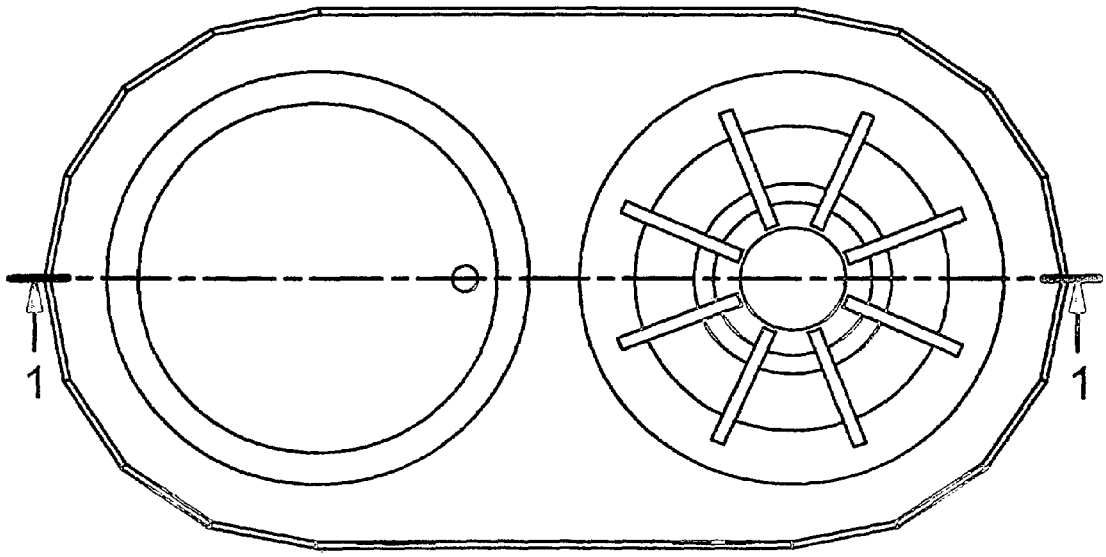
FIG. 3 is a plan view of the holder
Figure 4:
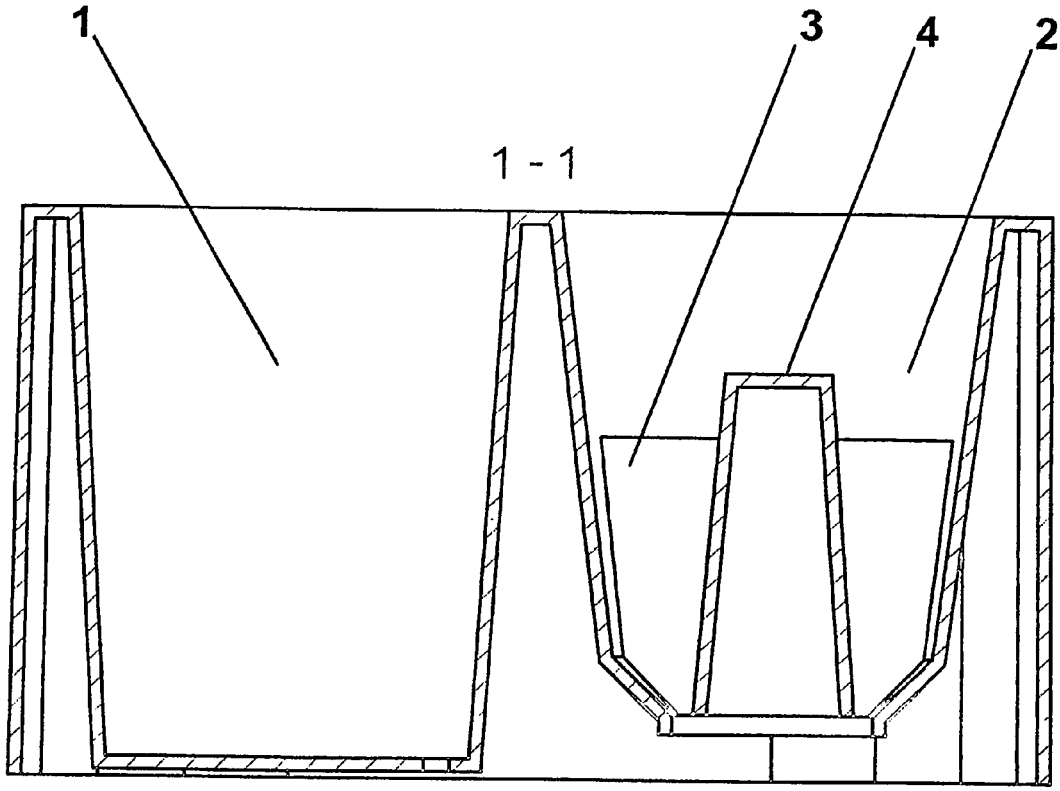
FIG. 4 is a cross-sectional view taken generally along the line 1-1 in FIG. 3
Figure 5:
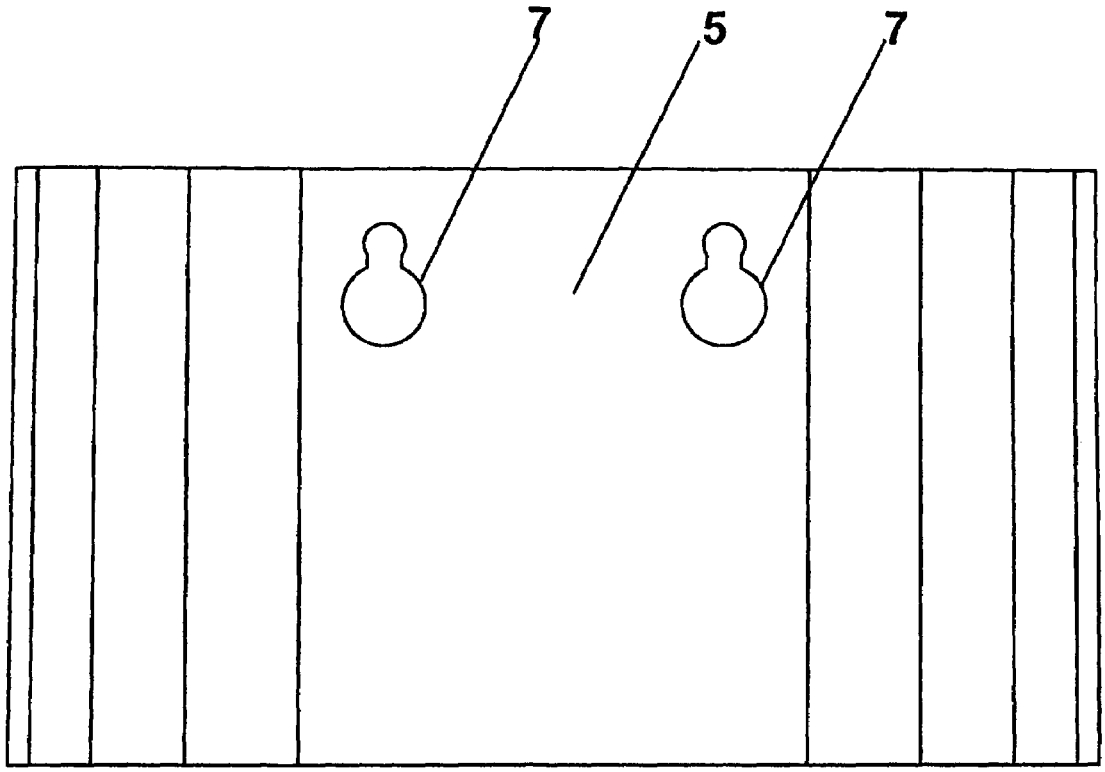
FIG. 5 is a front view (elevation view) of the holder
Figure 6:
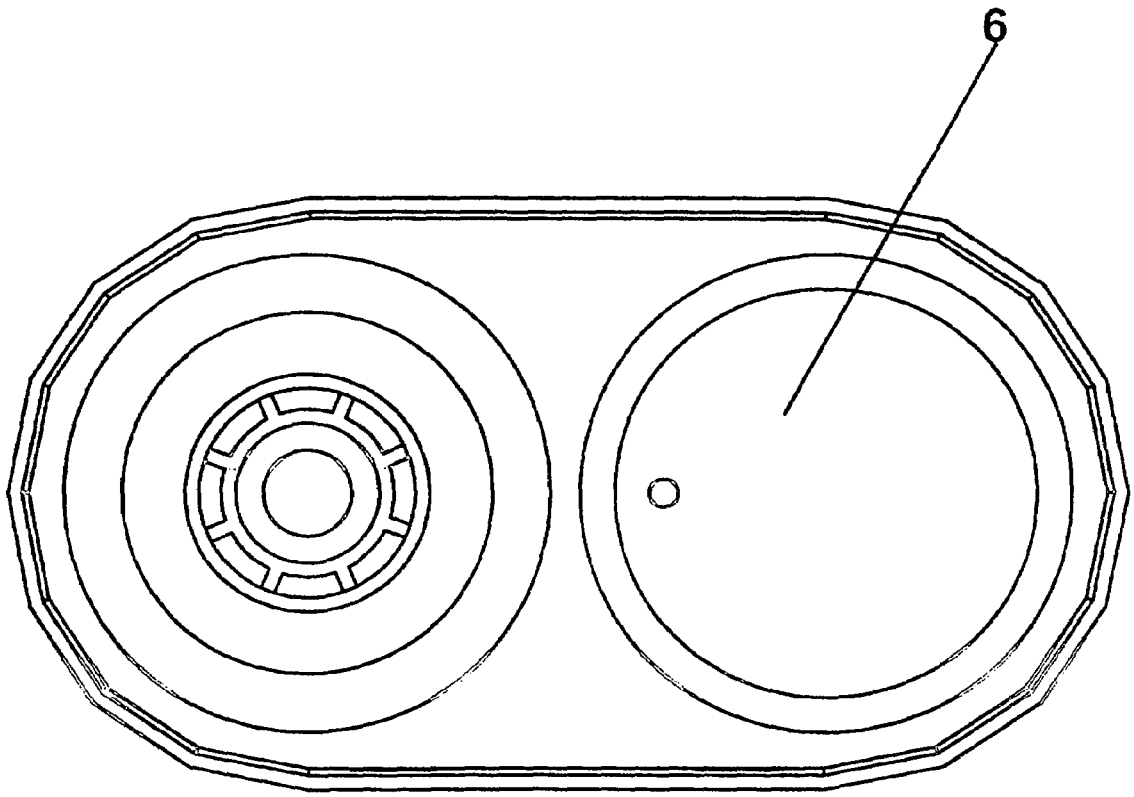
FIG. 6 is a bottom view of the holder

FIG. 1 is a perspective view of the container focusing on the top portion of the finished product that shows two different cylindrical shapes. Further looking at FIG. 3 and FIG. 4, one side of the container 1 appears to be typically slightly tilted round-shaped cup. The other side of container 2 is greatly tilted that circumference of the top is much greater than the bottom. It is composed of eight wing-shaped dividers 3 which are attached to a cone shaped post 4 in the opened middle body. For further understanding, FIG. 2 shows a cubic delineation of a cone shaped post 4 with eight wings 3 however these are the parts of a container which is a single body (one piece) mold injected plastic product.

Figure 7:
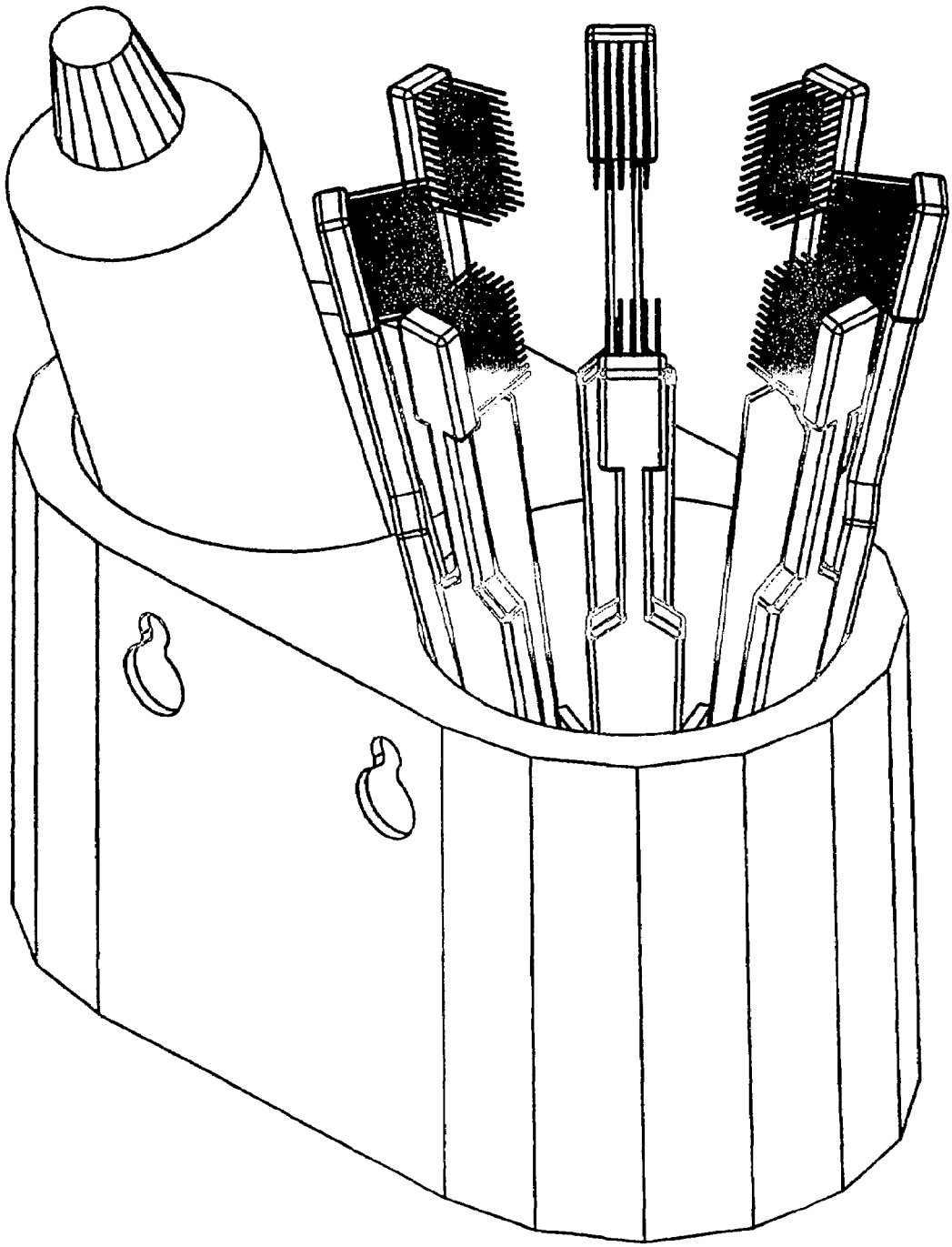
FIG. 7 is a perspective view of the holder with eight toothbrushes and one toothpaste are slightly tilted outward by gravity

FIG. 7 is a finished product that actually shows toothbrushes and a toothpaste rest in the container. Eight toothbrushes are tilted outward by its own gravity. The gravity prevents the toothbrush's body and bristles from touching each other. In addition, because of the bottom of the container is opened, any moisture on the toothbrush will be drained to the bottom of the container that keeps toothbrushes more sanitary.

Figure 8:
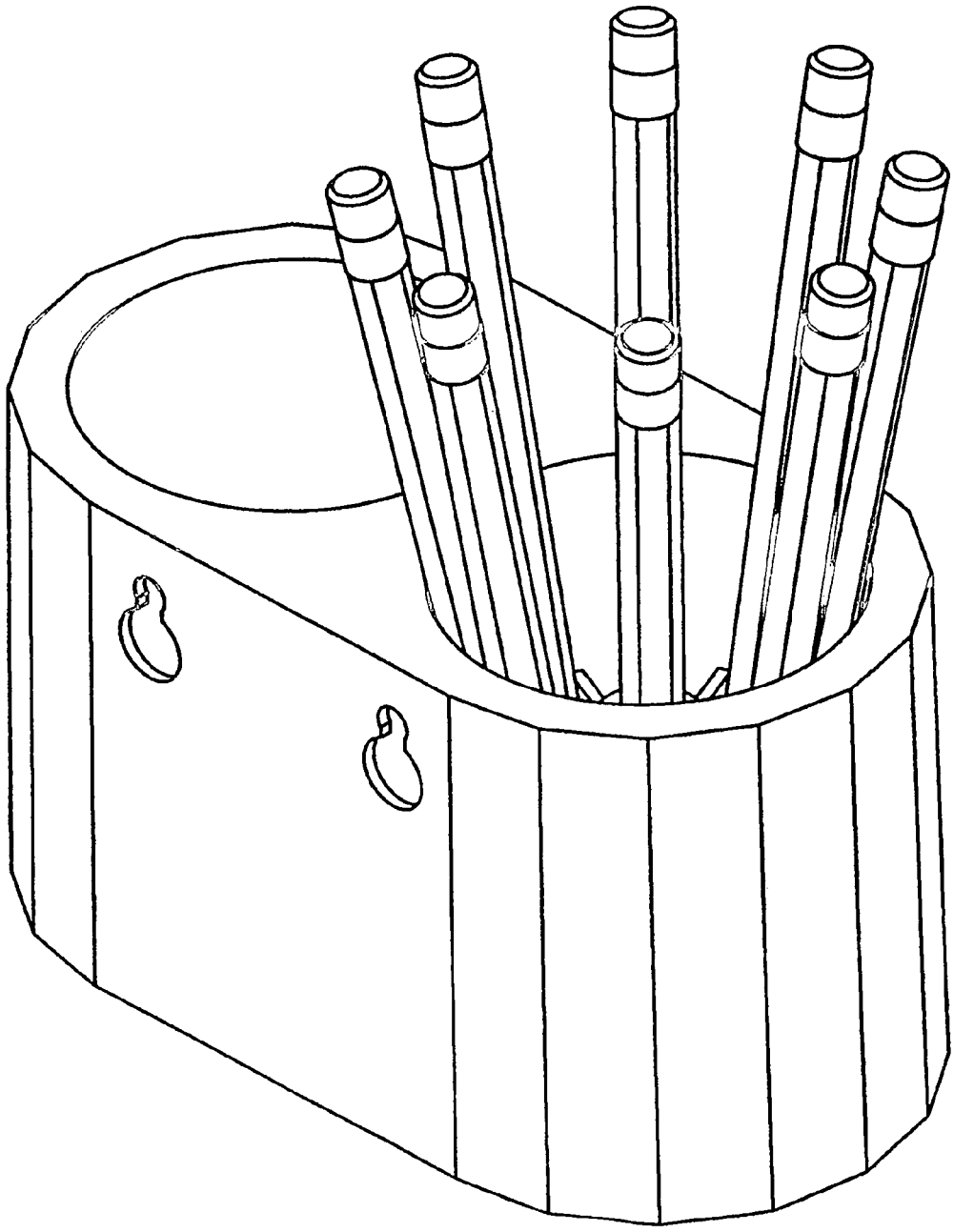
FIG. 8 is a perspective view of the holder with eight pencils (or ballpoint pens) are slightly tilted outward by gravity

FIG. 8 is a finished product utilizing as a utensil holder. Utensils such as glue, ruler and scissors can be stored in the one side 1 of the container and as seen in the picture, the other side 2 can hold pencils or mechanical pencils but the leads will not break by the lifted bottom and narrow gap shown in FIG. 3 and FIG. 4

Figure 9:
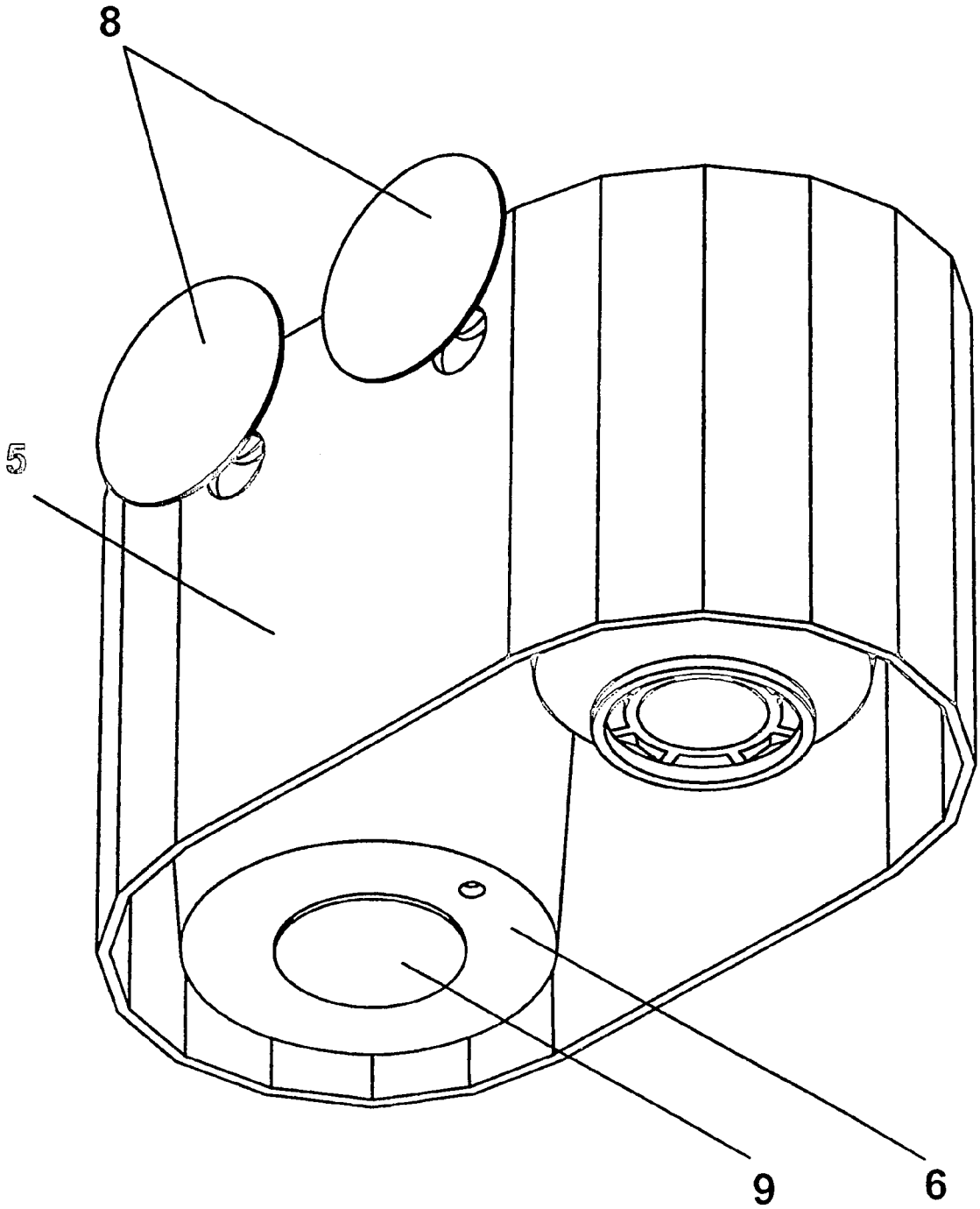
FIG. 9 is a perspective view focusing on front face and bottom area and showing the holder with two sucking disks on the front face and a double faced sticker on the bottom

FIG. 9 is a finished product where two sucking disks 8 are attached to snowman-shaped holes 7 on the front face 5 and a double faced sticker 9 on the bottom 6 that explains the holder can be easily mounted on the wall or flat table by using sucking disks 8 or double faced sticker(s) 9 depends on the condition of surface to be mounted.

The invention claimed is:

1. A toothbrush and toothpaste holder comprising:

a first cylindrical container;

a second cylindrical container comprising a bottom; and a cone shaped post comprising a plurality of dividers extended from the cone shaped post, along the longitudinal length thereof wherein the cone shaped post is disposed on the bottom of the second cylindrical container, wherein the plurality of dividers extend down to the bottom of the second cylindrical container.

2. The holder of claim 1, wherein the plurality of dividers define the plurality of substantially separate compartments with the cone shaped post and the second cylindrical container, and wherein the second cylindrical container comprises the plurality of openings at the bottom of the compartments.

3. The holder of claim 1, wherein the first and second cylindrical containers and the cone shaped post are integrated into one body.

4. The holder of claim 1, further comprising two sucking disks that mount the holder on a flat surface.

* * * * *